United States Patent [19]

Tommaney et al.

[11] Patent Number: 4,953,177

[45] Date of Patent: Aug. 28, 1990

[54] METHOD AND MEANS OF REDUCING THE OXIDIZATION OF REACTIVE ELEMENTS IN AN ELECTROSLAG REMELTING OPERATION

[75] Inventors: Joseph W. Tommaney, Lockport; Peter S. Andolina, Cheektowaga; Reginald C. Buri, Gasport, all of N.Y.

[73] Assignee: Allegheny Ludlum Corporation, Pittsburgh, Pa.

[21] Appl. No.: 375,117

[22] Filed: Jul. 3, 1989

[51] Int. Cl.[5] ..... H05B 7/00

[52] U.S. Cl. ..... 373/68; 373/42; 373/77; 75/10.24

[58] Field of Search ..... 75/10.24, 10.25, 10.64; 373/42, 44, 45, 77, 68

[56] References Cited

U.S. PATENT DOCUMENTS 4,117,253 9/1978 Wooding ..... 373/42

*Primary Examiner*—Roy N. Envall, Jr.

*Attorney, Agent, or Firm*—Patrick J. Viccaro

[57] ABSTRACT

A method and apparatus is provided for controlling the atmosphere above the bath of an electroslag remelting furnace, including sealing the atmosphere of the furnace directly above the crucible by employing a shell secured to the crucible and a shroud secured between the shell and the movable furnace ram to encapsulate the atmosphere, and analyzing the oxygen content of the atmosphere and controlling the amount of oxygen therein by introducing an inert gas in the atmosphere.

39 Claims, 2 Drawing Sheets

METHOD AND MEANS OF REDUCING THE OXIDIZATION OF REACTIVE ELEMENTS IN AN ELECTROSLAG REMELTING OPERATION

BACKGROUND OF THE INVENTION

This invention relates to the operation of electric powered furnaces, particularly electroslag remelting furnaces (ESR) and to a method and apparatus of continuously controlling the atmosphere within such furnaces to result in improved chemistry control and improved cleanliness of the final produced metal.

Some electroslag remelted ingots contain reactive elements which are easily oxidized, and therefore present serious problems in both chemical composition control and cleanliness of the metal. The atmosphere above the slag bath in an electroslag furnace has a dramatic influence on both the chemistry and cleanliness of the metal of the remelted ingot. Both the oxygen contained in the air and the moisture content of the air normally present in the furnace are significant factors. The oxygen combines with reactive elements to form oxides. The oxides are retained in the slag bath thereby depleting the metal of that specific element. Elements removed by this mechanism often cause the base metal to fall below desired specifications for these elements. Moreover, the oxidization process is not uniform throughout the finally produced ingot. Particularly, reactive elements are depleted more rapidly at the start of the melting process. The oxidization rate is gradually reduced as melting proceeds until it abates completely when the content of the reactive element in the metal is in equilibrium with its oxide species in the slag. Consequently, in many cases it is not possible to hold critical elements within specification nor to maintain them uniformly from top to bottom of the resultant ingot. In addition the composition gradient between top and bottom of the melt often presents difficulties in determining heat treatment times and temperatures to develop specific mechanical properties.

A basic consideration of the control of the furnace atmosphere above the slag bath is &:he need to develop a means and method to preclude the presence of oxygen from the atmosphere. In order to determine the effectiveness of any techniques devised to accomplish this end, it is necessary to find an effective method and means to measure the oxygen content above the slag bath. Analytical equipment is available to accurately determine the oxygen level. A problem exists, however, in the sampling of the atmosphere above the slag bath. Oxygen analyzers draw a gas sample from the furnace atmosphere which contains solid particles evolving from the slag and very quickly plug the sample tube. Consequently, in the past, atmosphere samples could be obtained only during the early portion of the heat.

DESCRIPTION OF THE PRIOR ART

The problems cited above are well known to those skilled in the art of electroslag remelting and several approaches have been suggested and in some cases attempted to resolve the problems. One approach was to encapsulate a preformed remelt electrode within a water cooled structure, preferably fabricated from metallic components, with a vacuum tight sliding seal to allow the ram, or current carrying component to the electrode, to feed the electrode to the metallic bath, while excluding any communication to the atmosphere.

An example of such a device would be a vacuum arc remelt furnace used to perform ESR.

This type of furnace can be operated in two ways. The furnace can be exhausted to as low a pressure as permitted by the vacuum system and melting at this pressure, or said furnace can be back filled to a higher pressure with inert gas and melting carried out at the higher pressure. In both instances a cold start slag practice would be used. Cold start slag practice may be briefly explained as touching the bottom of the electrode to the base plate of the crucible or metallic starting substance. A predetermined quantity of slag or flux material is then poured around the electrode into the annular area between the mold and electrode. The furnace is then sealed and exhausted to the desired pressure level. Depending on the melt practice specified, the pressure is either that limited by the capacity of the vacuum pumps, or a higher pressure achieved by the introduction of an inert gas.

Melting is initiated by energizing the power source which results in a short circuit condition between the bottom of the electrode and the starting charge or crucible base. At this point the electrode is retracted causing an electric arc to be formed between said electrode and base. The heat generated by this arc causes the slag material surrounding the electrode to melt. When melting of the slag is completed or close to completion the connection is made between the end of the electrode through the newly formed liquid slag to the base. Thus the process changes from an arc heating process to a resistance heating process.

It has been found that the use of a vacuum on the order of a one Torr over the slag produces melting instabilities resulting in poor ingot surface and internal ingot quality. In counter distinction, melting at inert gas pressures approaching atmospheric pressure as well as atmospheric pressure produces good ingot surfaces and internal conditions including the protection of reactive elements. This process, however, is cumbersome, resulting in decreased productivity and equipment maintenance problems caused by the corrosive slag fumes coating internal surfaces, causing the ram to bind when retracted through the seal and of fumes being carried into the vacuum system.

Another method used to prevent the loss of reactive elements in electroslag remelting is to determine the thermodynamic equilibrium between the reactive element considered and its oxide species in the slag. In theory one could add an equilibrium concentration of the reactive oxide species to the electroslag flux and thus keep the reaction from proceeding in the direction of forming the oxide species. There are several problems, however, associated with this approach. First, the supply of oxygen above the bath is essentially the atmosphere, representing for all practical purposes, an inexhaustible supply of oxygen and consequently providing a driving force to maintain a non-equilibrium condition in favor of more oxide formation. Second, the oxide species of concern may not be readily available for addition to the starting slag or may be cost prohibitive. For example a different equilibrium would exist for MO, $M_2O_3$, $M_3O_4$, M in this case being a general term for any element e.g. Al, Ti, Cr, Mn, etc. Third, excessive addition of a particular oxide species will alter the physical properties of the primary slag. It may also revert the element to the metal. Electroslag fluxes are designed to operate within certain constraints with regard to factors such as, but not limited to, liquids and solidus temperatures, vapor pressure and electrical conductivity. All of these factors are dependent upon composition.

Another method used to prevent or retard the oxidization of reactive elements consists of the use of a furnace similar in construction to that described above with reference to the vacuum arc furnace, which is the normal ESR furnace, except that the ram seal is not a close tolerance seal of the type used in conventional vacuum arc remelting furnaces, but allows a gap between the ram and the furnace structure. This gap avoids the binding problem caused by the ram coating with slag fume condensation but requires the use of high volumes of expensive inert gas since, it does not form a complete seal. High volumes of inert gas under these conditions can allow the aspiration of air into the furnace with attendant safety problems.

Lastly, in some instances, a determination is made to allow for the loss in reactive elements by adding an additional proportion of the elements to the primary melt and allowing the elements to fade to the desired level. The objection to this practice is that additional quantities of the elements, which are normally the more expensive elements, are lost resulting in an additional manufacturing cost. Also this practice does not resolve the problem of top to bottom element composition gradients in the resultant ingots. It was also found that the loss of the reactive element was not at a consistent level.

SUMMARY OF THE INVENTION

The object of this invention is to provide means, methods and materials to diminish the loss of reactive elements and to provide better uniformity from top to bottom of an ingot during the electroslag remelting of alloys such as iron, nickel and cobalt base alloys. For illustration purposes, such elements may include, but not be limited to, silicon, aluminum, titanium, zirconium, cerium and lanthanum. As a preferred embodiment, the invention provides a method to accomplish its objective while preserving the flexibility to alternate, if desired, between the method and means of the invention, and conventional electroslag melting techniques. The objective is accomplished by controlling, for example by measuring, certain factors of the atmosphere over the slag bath either separately or in combination with equilibrium slag considerations. More particularly the present invention provides a means and method of operating an electroslag remelting furnace having a ram movable relative to the crucible thereof during the melting operation, the steps of encapsulating the atmosphere above the molten slag in the crucible in a manner to substantially prevent escapement of the atmosphere during the movement of the ram, during the first step monitoring the oxygen level in the furnace atmosphere, and as a function of the monitoring step, introducing into the furnace atmosphere an inert gas to maintain the oxygen at a desired level. According to the invention a slight positive pressure of the inert gas is maintained to prevent or minimize influx of oxygen (air) through leaks.

DETAILED DESCRIPTION OF THE INVENTION

Figure 1:
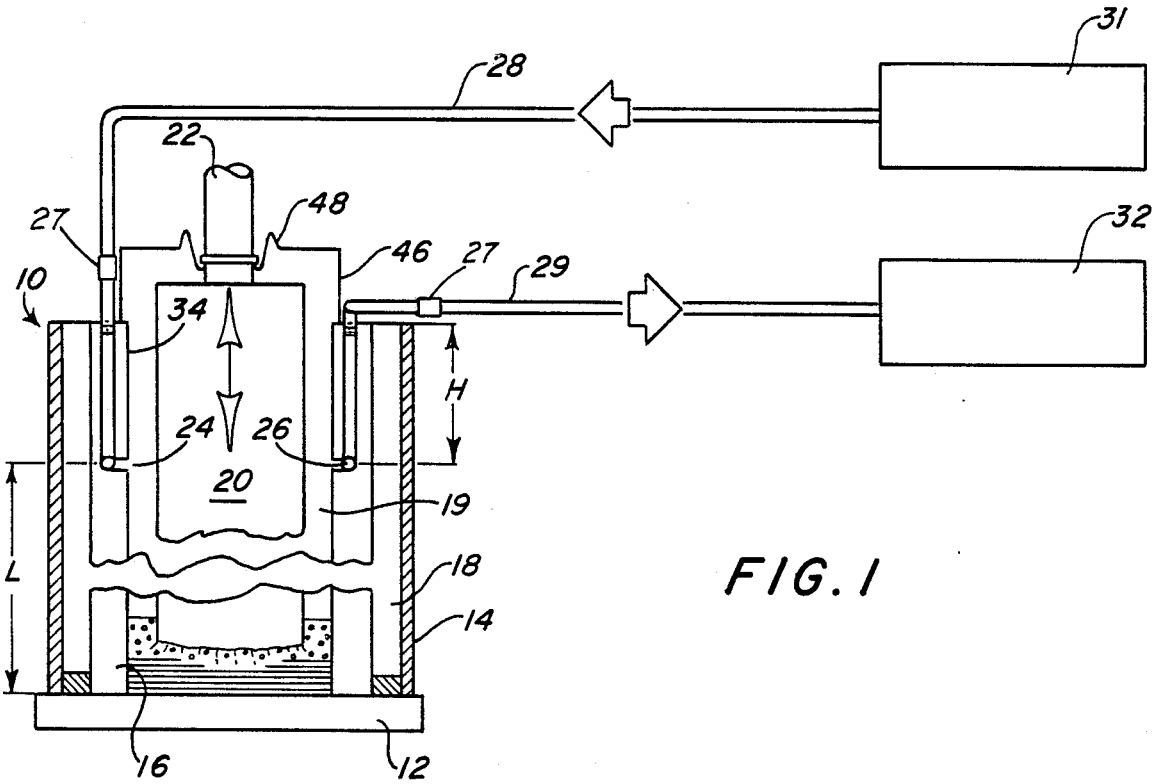
FIG. 1 is a schematic sectional elevational view of a portion of an electroslag remelting furnace, particularly illustrating the gas entry and oxygen sampling ports of the present invention.

The invention provides an economically viable solution to the aforementioned difficulties of measuring and controlling the atmosphere above the bath in a furnace such as an electroslag remelt furnace. It involves three important cooperative improvements which are (1) the provision, construction and location of gas introduction and sampling ports designed to be protected from plugging by solid particulate from slag fumes, (2) an effective but yet readily installable furnace shell, and (3) a movable seal portion secured to the shell and in one form covering the area between the shell and power conductor and electrode support known to those skilled in the art as the ram. A more detailed description of each of these features will now be given.

The controlling of the atmosphere within the furnace above the bath according to the present invention resides in part in the employment, construction and arrangement of gas entry and sample ports. With reference to the size and location of the gas entry and sample extraction ports attention is directed to FIG. 1, where there is shown a generally customary electroslag remelting furnace 10 of the type employed to produce iron, nickel and cobalt alloy ingots. The furnace includes, in accordance with well known practice, a crucible base 12, a stainless steel jacket 14 which encloses a copper mold 16 of the crucible, and forms a water cavity 18 with the jacket, the opening 19 of the mold being arranged and adapted to receive an electrode 20 having at its upper end a ram 22, the electrode being loaded from the top of the mold. Also as is well known, the base 12 and sections of mold 16 should provide good mechanical seals to minimize air/oxygen aspiration into the bath area.

As indicated above, according to the present invention there is provided in the mold 16 and arranged to extend into horizontally deposed ports 24 and 26 of an oxygen control system and a measuring system, respectively. While only one port of each system is shown, it is to be understood that each system may include several ports strategically located. These ports include couplings 27 for connecting the ports through vertical passages fabricated in the mold to separate lines or conduits 28 and 29 connected to an inert gas source 31 and an oxygen analyzer 32, respectively. The couplings may be of a well known type such as Hansen Quick Disconnect, ¼ inch NPT, arranged to communicate with the internal confines of the mold 16 through the interior mold surfaces 34 at a predetermined point designated in FIG. 1 as a distance or height H. H representing the minimum distance from the top of the mold, approximately the deepest point possible in the mold that will not be covered by the slag cap of the remelted ingot when it reaches its maximum length designated L also in FIG. 1. In the illustrated case, as an example, H approximates 10 to 18 inches (25.4 to 45.7 cm) from the top of the mold 16. The oxygen analyzer 32 can be one of several type, one being an oxygen analyzer supplied by Teledyne Company model 326 RB. It has been found from experience that the minimum size of the passageways 24 and 26 to be approximately 5/16 inch (7.94 mm).

This arrangement provides two distinct advantages over methods which introduce gas and obtain samples from locations at the top of or at a location above the mold. These advantages include an accurate measurement of the critical control variable, oxygen level, and introduction of inert gas at a point less likely to aspirate air from any leak in the furnace shell or ram seal. It should be pointed out that the internal location of the passageways 24 and 26 within the mold wall provide an unencumbered means of injecting and sampling gas, without addition of tubes or other conduits inserted in the annulus between the electrode and the mold wall. The tubes or conduits could cause an electrical short circuit between the electrode and mold with resultant mold damage, if fabricated from an electrically conducting material, such as metal. If such tubes were fabricated from a dielectric material such as refractories, they could be thermally shocked or mechanically damaged. Portions of the tubes would then fall into the slag bath causing melt related problems.

Figure 2:
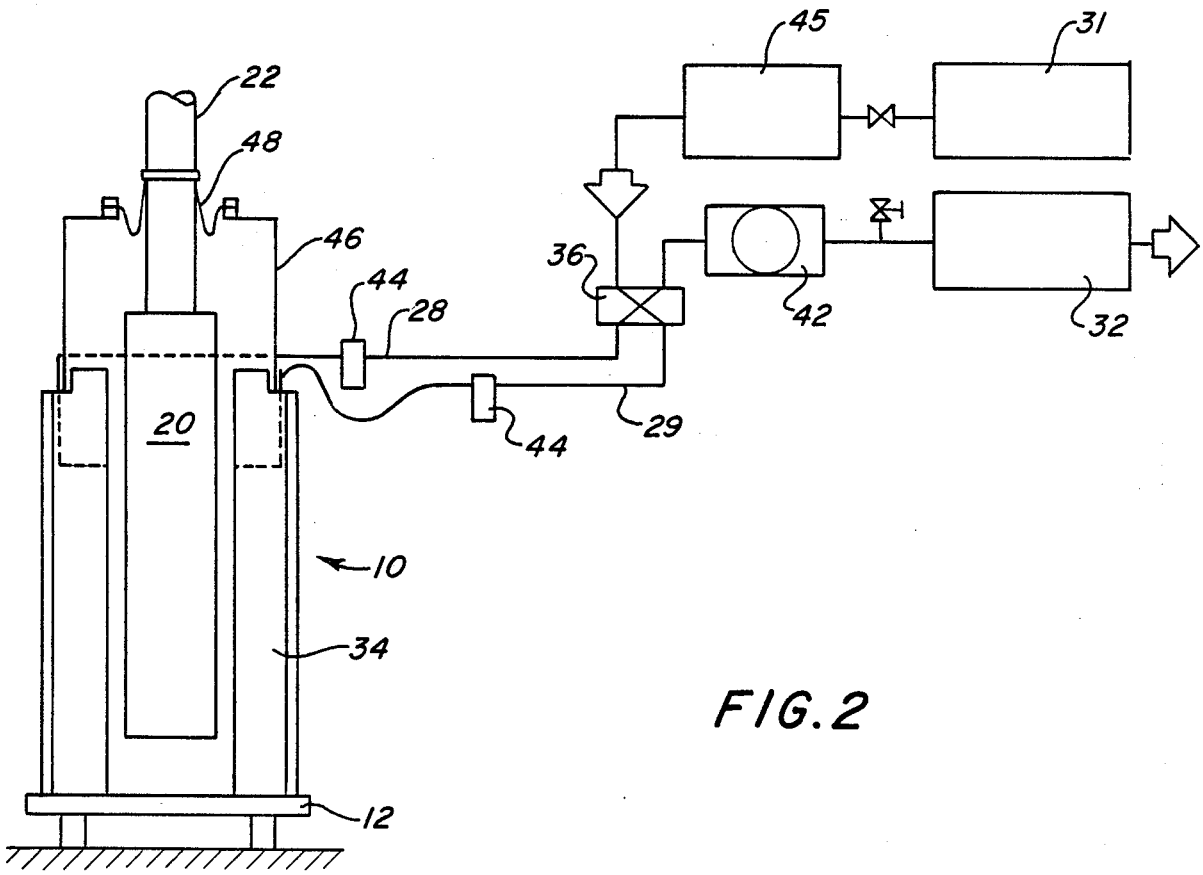
FIG. 2 is a schematic view of an atmosphere controlling and mold purge system according to the present invention.

As noted previously, it was found in past arrangements that the gas sampling port was prone to inhale solid particulate, from fumes emanating from the slag bath, as well as the normal gaseous atmosphere. After a short time the particulate plugged the sample line and eliminated measurement of the oxygen partial pressure in the furnace atmosphere, the oxygen partial pressure being a scientific term representing the metered percentage of oxygen in a sample, in the instant case the furnace atmosphere. Since measurement of the oxygen partial pressure is an important control parameter the present invention provides, as illustrated in FIG. 2, a means and a method to overcome this difficulty. In FIG. 2 and the following views, like components and characteristics are identified with like reference characters.

The measurement is accomplished by installing a multi-position valve 36 in the gas injection and sampling lines 28 and 29, respectively, associated with the inert gas source 31 and the oxygen analyzer 32. The pressures in the lines can be 60 psi to produce a flow of gas in the range of approximately 60 to 80 CFH. The function of this valve 36 is to allow the line 28 to supply inert gas at all times or to discontinue suction on the sample line 29, except when a sample of the oxygen partial pressure over the slag bath is desired. The preferred procedure would be to flow argon at all times except when sampling. Other inert gases such as nitrogen can also be used. The valve 36 also allows argon gas to be introduced into both lines 28 and 29 as a means of keeping the lines clean. When an oxygen sample is desired, the valve would be repositioned so that the flow of inert gas would be cut off and the tube exhausted by means of the sample pump connected to the oxygen analyzer. After a suitable time delay to allow the system to clear the residual inert gas in the entry port an oxygen reading is taken and recorded. Although in a simple form the system can be operated with a manual valve control and hand logged data, if desired such valve control can be performed with electro-mechanical or computer control. In still referring to FIG. 2, the valve 36 can be of a well known construction and, as noted, be either a manual or solenoid timer controlled 4-way purge type arranged in lines 28 and 29.

With reference to the oxygen analyzer 32, which may include a digital readout, an exhaust pump 42 is shown arranged between the meter and the valve 36, previously mentioned, which is of a 4-way type. In an alternative embodiment (not shown) analyzer 32 can be arranged upstream of pump 42 so as to operate at a negative pressure On the other side of the line 29 between the valve 36 and furnace 10 is installed a filter 44. Between the gas source 31 and the valve 36 in line 28 is installed a flow meter 45, a similar meter 45 also being installed in the line 29, which elements may be of the type well known in the industry. In the usual way the analyzer 32 is provided with an exhaust and the pump line with a vent according to usual practice.

Figure 4:
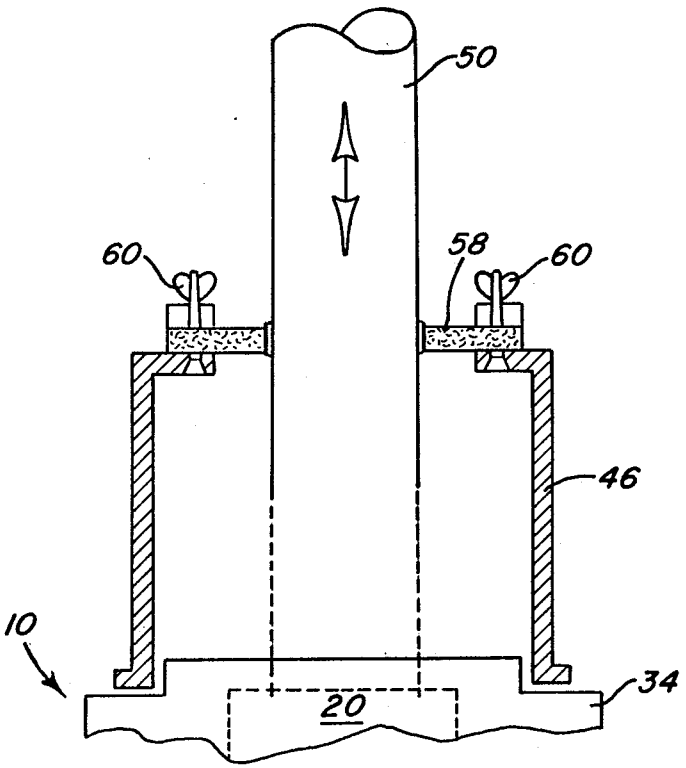
FIG. 4 is a still further embodiment of the shroud and sealing arrangement.
Figure 3:
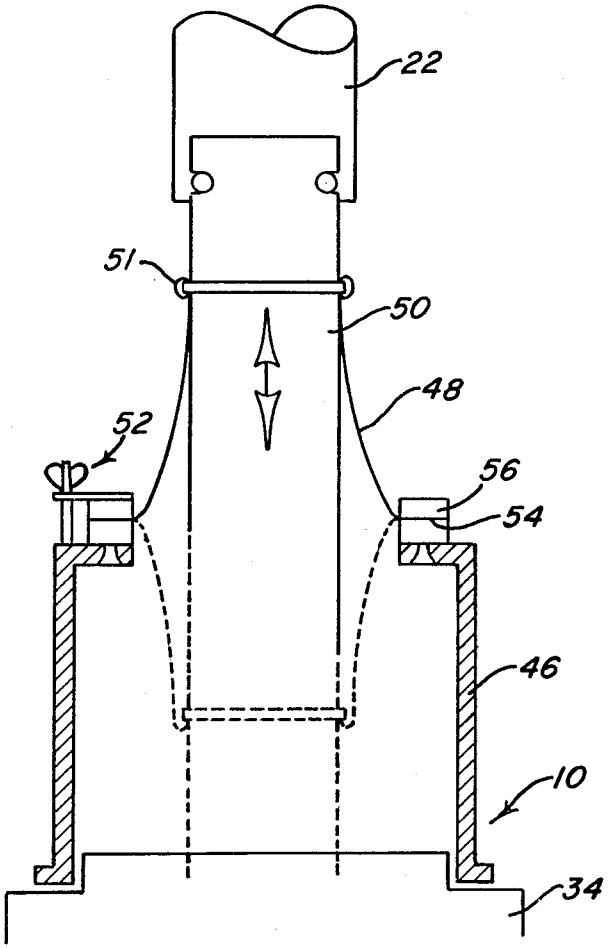
FIG. 3 is an enlarged elevational view of the shroud and sealing arrangement illustrated in FIG. 2.

With reference now particularly to FIGS. 2, 3, and 4, the furnace 10 is provided with a shell 46 constituting a mechanical barrier, fabricated from a material capable of withstanding the high heat and corrosive environment produced by the slag fumes. In the preferred form the shell takes the form of two generally similarly dimensioned split halves divided vertically. Also in the preferred embodiment, the shell is light weight, easily manipulated for rapid installation and removal from the furnace by a normal furnace crew. One example of such a two piece shell would be to fabricate it from a low inductive heat generating (non-magnetic) material, such as aluminum, capable of withstanding temperatures in the order of 800° F. (427° C.). In some cases air cooling of the shell to maintain lower temperature may be provided The aluminum or an aluminum alloy sheet can be of a thickness sufficient to maintain structural stability, for example, of approximately 3/16 inch (4.76 mm). The exact design or materials used to form the shell, or the presence of specific ports, access features for sampling, cooling fins or other customary appendages can be provided for as needed in a manner that will not distract from the shell being easily removed or installed to accommodate melting conditions. The two piece shell unit can be installed after the stub welding is complete and after the slag is charged. Depending on the size and shape of the shell required for a given furnace a one piece shell may create difficulty in charging the furnace. Thus it will be seen that the invention provides an effective barrier for the purpose intended and one that will represent a substantial economic advantage over a fixed solid structure.

With reference still to the embodiment of FIG. 1 and in referring to the rapid initial oxidation of the reactive elements when combined with the oxygen (which is characteristic of ESR furnaces), the present invention provides a system for controlling the furnace atmosphere in relation to the equilibrium slag condition. In this regard the invention provides for the introduction of the inert gas during the initial remelting operation to reduce oxidation of the reactive elements until the equilibrium of the slag is reached, thereby improving the uniformity of the distribution of desired elements It is also believed that when the inert gas shrouding is used together with the known use of previously used slag, the benefits of the present invention are enhanced. More specifically, previously used slag has less hydroxides and thus less oxygen content. Furthermore, it has an oxide species more closely matched to the oxide species associated with the electrode being remelted.

Turning now to the second novel cooperative feature of the present invention of providing a gas seal between the internal confines of the mold 16 and the atmosphere, this is accomplished by constructing a shroud or boot arrangement as shown in FIGS. 2 and 3. The shroud 48 is fabricated from a high temperature insulating cloth material such as the commercially available product sold under the trade name "Siltemp" capable of withstanding approximately 800° F. (427° C.). The shroud is cut from a pattern to form an essentially conical shape when sewn together with "Siltemp" thread. The top of the cone is sealed to the ram stub 50 of the power ram 22 by means of a simple clamping arrangement 51 including a wing nut clamp 52 in a manner to essentially eliminate any gap therebetween. The bottom portion of the cone is incorporated into a seal arrangement with a high temperature, heat resistant non-magnetic material 54 such as sold under the trade name "Ryertex". The seal arrangement 54 is fastened such as by bolts 56 to the top of the shell 46, in a manner to obtain the desired sealing condition.

Alternatively, instead of the shroud 48 a sliding seal means 58 can be employed instead of the positive directly connected type described above, using the same shell 46. This arrangement is illustrated in FIG. 4. The seal 58 is arranged between the stub 50 of the power ram 22 and furnace shell 46, being composed of a soft heat resistant and non electrically conductive material such as sold under the trade name "Fiberfrax" material which can take the form of a ceramic fiber seal of the type sold under the trade name "Carborundum". In this arrangement the stub 50 passes through the sliding seal 58 formed by a ring of the soft heat resistant material in contact with the stub and secured to the top of the shell 46 by a series of fasteners or wing bolts 60. This material must be electrically insulating since contact between the ram and the material would cause electrical damage through arcing. One of the important considerations in the use of this seal arrangement is to make sure the pressure needed to form the seal between the ram and shell does not interfere with the function of the load cell device used to continuously weight the electrode during the melt cycle.

EXAMPLE I

In now briefly describing the employment of the above described invention for Heat 051293-1 in an ESR operation, a 8×34 inch (20.3×86.3 cm) electrode was loaded into the ESR furnace. The heat was for an A 286 alloy which normally contains 15% Cr, 26% Ni, 1.25% Mo, 2.1% Ti and 0.25% Al, balance iron, by weight percent. The movable seal 48, was attached to the power ram 22 as shown in FIG. 3. The furnace shell 46 was placed on the top of the crucible 10 and bolted thereto. The movable seal 48 was then connected to the furnace shell 46 by means of bolts 56. Argon gas was then introduced into the crucible. When the oxygen level within the crucible reached a predetermined level, in this case about 2%, the melting operation was initiated. Melting was initiated using what is known in the trade as a cold start practice. Melting then proceeded by conventional ESR refining techniques except that the atmosphere above the slag bath contains about 2% oxygen rather than the atmospheric about 20%. Sampling of the oxygen level was performed at predetermined time intervals, for example at time intervals approximately 30 minutes. When it was found that the oxygen level began to increase, a compensating increase in argon flow was made. Argon flow was maintained for 20 minutes after the end of the melt. In the preferred embodiment it is desirable to operate the furnace at less than a 2% oxygen atmosphere within the furnace 10. It was found, however, that good results can be obtained with oxygen levels of up to 5%. Moderate improvement with levels above 5% and ranging as high as 12% were observed.

Titanium analysis taken from the top and bottom of the resultant ESR ingot determined the ingot top portion to be 2.30% and the bottom portion to be 1.98%. The starting electrode titanium analysis was 2.33%. The 0.03% loss at the top of the ingot marked a major improvement over the normal 0.2% loss obtained on enshrouded ingots and probably lies within the analytical accuracy range for titanium As expected the bottom titanium loss was the same as the bottom losses observed on enshrouded heats. This is attributed to two factors. The initial slag contains a small quantity of moisture in the form of hydrates which cannot be baked out and which can oxidize the titanium independent of the atmosphere in the furnace and during the initial part of the melt the correct species of titanium oxide for equilibrium purposes has not been generated by the melting process.

EXAMPLE II

Seventeen (17) additional heats of A 286 alloy were melted and prepared in accordance with the practice of Example I and compared with 58 heats made in conventional enshrouded practice. The mean value of the starting electrode titanium analysis for the enshrouded practice was 2.34% and for the shrouded practice of this invention was 2.21%. Analysis from the remelted material was taken after cold rolling each ingot to final gauge by sampling the coil every fifty (50) feet from edge trimmed material. The "in" end of the coil corresponds to the top of the ESR ingot and the "out" end of the bottom of the ingot. For the enshrouded practice, the mean top analysis was 2.01% (for a 0.33% Ti loss) and mean bottom analysis was 1.96% (for a 0.38% Ti loss). For the shrouded practice of the present invention, the mean top analysis was 2.12% (for a 0.09% Ti loss) and mean bottom analysis was 1.98% (for a 0.23% Ti loss). The bottom titanium analysis was approximately the same for both the shrouded and enshrouded practice although the starting electrodes analyses were different. Such lower titanium losses mean reduced production costs associated with the cost of the reactive metal additives, such as Ti, to the master heat. There still existed the difference in Ti between the top and bottom of an ingot although the differences were less for the enshrouded heats than for the shrouded practice. Although same improved uniformity was obtained, such differences between the top and bottom can be attributed to the same reasons as described in Example I. As also noted above, one way of obtaining an increase improvement in uniformity of ingot composition from end to end would be to reuse the slag used for the same alloy, during which prior use the reactive elements of concern achieved substantial equilibrium.

As was an object of the present invention, a method and apparatus are provided to minimize/or prevent the loss of reactive elements attributed to oxygen present above the molten bath and a preferred embodiment which minimizes bottom to top reactive element segregation in a resultant ingot.

Although a preferred and alternative embodiments have been described, it will be apparent to one skilled in the art that changes can be made therein without departing from the scope of the invention. Moreover, while electroslag remelting furnaces (ESR) have been exclusively referred to, it will be appreciated that the invention can be employed in other types of electric furnaces.

We claim:

1. A method of operating an electric powered furnace having a ram movable relative to the crucible thereof during the melting operation, the method comprises:

encapsulating an atmosphere above a molten slag in said crucible in a manner to substantially prevent escapement of said atmosphere during said movement of said ram, during said encapsulating step, monitoring the oxygen level in said atmosphere, and as a function of said monitoring step, introducing into said atmosphere an inert gas to maintain the oxygen at a desired level.

2. In a method according to claim 1, wherein said furnace is an electroslag remelting furnace.

3. In a method according to claim 2, wherein said monitoring step includes sampling the oxygen level in said atmosphere at a location sufficiently above the maximum ingot length in said crucible to reduce the opportunity of solid particles of the molten slag interfering with the monitoring step.

4. In a method according to claim 2, wherein said introducing step includes introducing the inert gas at a location sufficiently above the maximum ingot length in said crucible to reduce the opportunity of solid particles of the molten slag interfering with the introduction of said inert gas.

5. In a method according to claim 2, wherein said inert gas comprises argon gas.

6. In a method according to claim 2, the additional step of maintaining the oxygen level at less than 12%.

7. In a method according to claim 2, the additional step of maintaining the oxygen in said atmosphere at less than about 2% oxygen level.

8. In a method according to claim 2, the additional step of maintaining the flow of inert gas for a period of time after the end of the melt.

9. In a method according to claim 2, the additional step of increasing the amount of inert gas as a function of an increase measurement of the amount of oxygen in said atmosphere to maintain the oxygen level in said atmosphere at a desired level.

10. In a method according to claim 2, wherein said introduction of said inert gas is controlled to maintain a desired oxygen level until the reactive elements in the slag are in equilibrium.

11. In a method according to claim 1, wherein said step of introducing into said atmosphere an inert gas includes diluting the level of the oxygen in said atmosphere by said inert gas.

12. In the method according to claim 6, wherein said monitoring step includes sampling the oxygen level in said atmosphere at a location sufficiently above the maximum ingot length in said crucible to reduce the opportunity of solid particles of the molten slag interfering with the monitoring step.

13. In a method according to claim 6, wherein said introducing step includes introducing the inert gas at a location sufficiently above the maximum ingot length in said crucible to reduce the opportunity of solid particles of the molten slag interfering with the introduction of said inert gas.

14. In a method according to claim 6, wherein said inert gas comprises argon gas.

15. An electric powered furnace having a ram movable relative to the crucible thereof during the melting operation, the furnace comprising:

means for encapsulating an atmosphere above a molten slag in said crucible in a manner to substantially prevent escapement of said atmosphere during said movement of said ram, means for monitoring the oxygen level in said atmosphere, and means for introducing into said atmosphere an inert gas to maintain the oxygen level at a desired level.

16. In an electric powered furnace according to claim 15, wherein said furnace is an electroslag remelting furnace.

17. In an electroslag remelting furnace according to claim 16, wherein said monitoring means includes means for sampling the oxygen level at a location sufficiently above the maximum ingot length in said crucible to reduce the opportunity of solid particles in said atmosphere interfering with the operation of said monitoring means while sufficiently close to the top of the slag for accurate monitoring.

18. In an electroslag remelting furnace according to claim 16, wherein said introducing means includes means for introducing said inert gas at a location sufficiently above the maximum ingot length in said crucible to reduce the opportunity of solid particles in said atmosphere interfering with the operation of said means for introducing said inert gas while sufficiently close to the top of the slag to minimize any contact with air.

19. In an electroslag remelting furnace according to claims 17 and 18, wherein the location of said sampling means and the location of said introducing means are approximately within ten to eighteen inches from the top of the crucible.

20. In an electroslag remelting furnace according to claim 17, wherein said inert gas is an argon gas.

21. In an electroslag remelting furnace according to claim 17, including a purge valve, a first conduit system for connecting said monitoring means to said crucible and said valve, a second conduit system for connecting said gas introducing means to said crucible and said valve, and said valve including means for interrupting the flow of said inert gas in said first conduit system and for exhausting said second conduit system incident to monitoring.

22. In an electroslag remelting furnace according to claim 21, wherein said first and second conduit systems include ports formed horizontally in the wall of said crucible opening into the interior thereof.

23. In an electroslag remelting furnace according to claim 16, wherein said encapsulating means includes a shell means arranged to be secured to said crucible, a shroud means arranged between said shell means and said ram being constructed and arranged to create a sealing relationship with said ram on movement thereof, and means for securing said shroud means to said shell means.

24. In an electroslag remelting furnace according to claim 23, wherein said shell means is made of aluminum and said shroud is made of a high temperature insulating cloth material.

25. In an electroslag remelting furnace according to claim 23, wherein said shell serves as a vertical extension and has approximately the same perimeter as said crucible and said shroud takes the form generally of a cone having its larger end secured to said shell and its smaller end secured to said ram.

26. In an electroslag remelting furnace according to claim 23, including a seal means arranged between said shell and said shroud when secured by said securing means, said seal means being made up of a heat resistant non-magnetic material.

27. In an electroslag remelting furnace according to claim 23, wherein said shell and said shroud are constructed of relative light weight to be easily installed and removed from the furnace.

28. In an electroslag remelting furnace according to claim 23, wherein said shell comprises two sections arranged on either side of said ram.

29. In an electroslag remelting furnace according to claim 16, wherein said encapsulating means includes a shell means arranged to be secured to said crucible, a ring shaped sealing means arranged on the ram side of and secured to said shell means in a manner that a relatively no gap sealing condition is created between the sealing means and said ram on movement thereof.

30. In an electroslag remelting furnace according to claim 28, wherein said sealing means is made up of a ceramic fiber material.

31. In an electric powered furnace according to claim 15, wherein said means for introducing into said atmosphere an inert gas includes means for diluting the level of the oxygen in said atmosphere by said inert gas.

32. In an electroslag remelting furnace according to claim 23, wherein said monitoring means includes means for sampling the oxygen level at a location sufficiently above the maximum ingot length in said crucible to reduce the opportunity of solid particles in said atmosphere interfering with the operation of said monitoring means while sufficiently close to the top of the slag for accurate monitoring.

33. In an electroslag remelting furnace according to claim 23, wherein said introducing means includes means for introducing said inert gas at a location sufficiently above the maximum ingot length in said crucible to reduce the opportunity of solid particles in said atmosphere interfering with the operation of said means for introducing said inert gas while sufficiently close to the top of the slag to minimize any contact with air.

34. In an electroslag remelting furnace according to claim 33, wherein the location of said sampling means and the location of said introducing means are approximately within ten to eighteen inches from the top of the crucible.

35. In an electroslag remelting furnace according to claim 23, wherein said inert gas is an argon gas.

36. In an electroslag remelting furnace according to claim 23, including a purge valve, a first conduit system for connecting said monitoring means to said crucible and said valve, a second conduit system for connecting said gas introducing means to said crucible and said valve, and said valve including means for interrupting the flow of said inert gas in said first conduit system and for exhausting said second conduit system incident to monitoring.

37. In an electroslag remelting furnace according to claim 36, wherein said first and second conduit systems include ports formed horizontally in the wall of said crucible opening into the interior thereof.

38. A method of operating an electroslag remelting furnace having a ram movable relative to the crucible thereof during the melting operation, the method comprises:

encapsulating an atmosphere above a molten slag in said crucible in a manner to substantially prevent escapement of said atmosphere during said movement of said ram;

during said encapsulating step, monitoring the oxygen level in said atmosphere by sampling the oxygen level in said atmosphere at a location sufficiently above the maximum ingot length in said crucible to reduce the opportunity of solid particles above the molten slag from interfering with the monitoring step while sufficiently close to the top of the slag for accurate monitoring;

as a function of said monitoring step, introducing into said atmosphere an argon gas;

said introduction being at a location sufficiently above the maximum ingot length in said crucible to reduce the opportunity of solid particles from the molten slag from interfering with the introduction of said argon gas while sufficiently close to the top of the slag to minimize any contact with air;

upon said sampling of said oxygen level indicating that the level in said atmosphere is greater than approximately 2% oxygen level, varying the amount of said argon gas introduced into said atmosphere to maintain the oxygen level in said atmosphere at a predetermined level below said 2% level; and maintaining the flow of argon gas for a period of time after the end of the melt.

39. An electroslag remelting furnace having a ram movable relative to the crucible thereof during the melting operation, the furnace comprising:

means for encapsulating an atmosphere above a molten slag in said crucible in a manner to substantially prevent escapement of said atmosphere during said movement of said ram, said encapsulating means includes a shell means arranged to be secured to said crucible;

a shroud means arranged between said shell means and said ram being constructed and arranged to create a sealing relationship with said ram on movement thereof;

means for securing said shroud means to said shell means and said ram;

said shell means being made of aluminum and said shroud being made of a high temperature insulating cloth material;

said shell serving as a vertical extension and having approximately the same perimeter as said crucible and said shroud taking the form generally of a cone having its larger end secured to said shell and its smaller end secured to said ram;

seal means arranged between said shell and said shroud and between said shroud and said ram when secured by said securing means, said seal means being made up of a heat resistant non-magnetic material;

said shell and said shroud being constructed of relative light weight to be easily installed and removed from the furnace;

means for monitoring the oxygen level in said atmosphere;

said monitoring means includes means for sampling the oxygen level at a location sufficiently above the maximum ingot length in said crucible to reduce the opportunity of solid particles in said atmosphere interfering with the operation of said monitoring means;

means for introducing into said atmosphere an argon gas to maintain the oxygen level in said atmosphere at a desired level;

said introducing means includes means for introducing said argon gas at a location sufficiently above the maximum ingot length in said crucible to reduce the opportunity of solid particles in said atmosphere interfering with the operation of said means for introducing said argon gas;

a purge valve;

a first conduit system for connecting said monitoring means to said crucible and said valve;

a second conduit system for connecting said gas introducing means to said crucible and said valve;

said valve including means for interrupting the flow of said argon gas in said first conduit system and for exhausting said second conduit system incident to monitoring, and said first and second conduit systems include ports formed horizontally in the wall of said crucible opening into the interior thereof.

* * * * *